US005815971A

United States Patent [19]

Rothe et al.

[11] Patent Number: 5,815,971

[45] Date of Patent: Oct. 6, 1998

[54] POSTER FRAME WITH MOISTURE SEAL

[75] Inventors: Peter F. Rothe, Schwalbach/Ts, Germany; David U. Hillstrom, Gilber, Mich.; Stefano Beretta, Milan, Italy

[73] Assignee: Marketing Displays, Inc., Farmington Hills, Mich.

[21] Appl. No.: 831,116

[22] Filed: Apr. 1, 1997

[51] Int. Cl.[6] ..... A47G 1/06; G09F 1/12

[52] U.S. Cl. ..... 40/718; 40/790; 40/792; 40/793

[58] Field of Search ..... 40/603, 718, 792, 40/790, 793

[56] References Cited

U.S. PATENT DOCUMENTS

| | | | |
|---|---|---|---|
| 2,601,734 | 7/1952 | Couzinet | 40/603 |
| 3,885,335 | 5/1975 | Egermayer | 40/790 |
| 4,145,828 | 3/1979 | Hillstrom | 40/793 |
| 4,512,094 | 4/1985 | Seely | 40/793 |
| 4,512,095 | 4/1985 | Seely | 40/793 |
| 4,519,152 | 5/1985 | Seely et al. | 40/793 |
| 4,523,400 | 6/1985 | Seely | 40/793 |
| 4,756,107 | 7/1988 | Hillstrom | 40/793 |
| 4,782,610 | 11/1988 | Hillstrom et al. | 40/793 |
| 4,932,146 | 6/1990 | Long | 40/156 |
| 5,307,575 | 5/1994 | Ivansson et al. | 40/793 |
| 5,353,536 | 10/1994 | Erber et al. | 40/718 |

*Primary Examiner*—Kenneth J. Dorner
*Assistant Examiner*—Fredrick Conley

[57] ABSTRACT

A poster display device for holding and displaying posters and advertising materials, particular in outdoor environments. A plurality of frame sections are positioned around the periphery of a backing member. The frame sections have rotating cover members which are biased by resilient members to be held in open and closed positions. A transparent protective sheet member is used to cover and protect the poster and advertising materials, and a sealing member is utilized to seal around the edges of the protective sheet member and prevent moisture and other environmental elements from coming into contact with the advertising materials and posters. The sealing members are positioned in slots, recesses, or channels in the frame sections and the force of the resilient members on the cover members holds the protective sheet materials tightly in place against the sealing members.

8 Claims, 4 Drawing Sheets

POSTER FRAME WITH MOISTURE SEAL

TECHNICAL FIELD

The present invention relates to picture and poster frames for displaying pictures, posters, and other display materials particularly in outdoor environments.

BACKGROUND OF THE INVENTION

One of the primary ways in which businesses advertise their products and/or services to the public is with the display of posters, billboards, and the like. Various types of frames and poster display devices are known for accomplishing this purpose. These display devices display various types of replaceable posters, advertising or other media, and are commonly employed on vehicles, such as buses or taxicabs, as well as on fixed objects, such as buildings, walls, posts, and the like. This form of communication is particularly important to businesses involved in large-scale organized distribution in which a customer's decision to buy a product is often made at the point of sale or in its immediate vicinity.

It is also known, to be effective, such method of advertising and communication must be displayed aesthetically and with proper quality and coloration. In particular, it is necessary that the poster display devices complement and not detract from the displayed advertisement in terms of form, color, and materials utilized, and it is preferred that the poster display devices enhance the content of the advertisement or display.

The poster display devices also should be reasonable in cost, relatively easy to install and utilize, and preserve the integrity of the poster or advertisement over an extended period of time. The poster display device also should allow change of the advertisement or poster in a relatively easy manner and require minimum maintenance and upkeep.

One known poster display device comprises a metal backing to which the advertisements are glued or otherwise fixedly secured. However, these devices are intended for low-cost, low-quality poster advertising in which the display is available only for limited short-term use. In this instance, the integrity of the advertisement or poster is not particularly important.

Another type of poster display device utilizes a rigid supporting back plate and a transparent protective sheet, for example, Plexiglas®, fixed at a suitable distance. The transparent member and rigid backing member form a space between them in which the advertisements or posters are inserted. These display devices do not protect the advertising material from environmental conditions, however. In wet environments, condensation typically forms on the inside of the transparent member and can obscure part of the advertising message or affect its integrity. Moreover, with fixed protective transparent members, the transparent members cannot be removed for cleaning.

Other known display holders are shown, for example, in U.S. Pat. No. 4,145,828 and Italian Patent No. 1,215,677. The poster display devices disclosed in these patents utilize a backing plate member to which a frame formed of individual frame sections is attached. The frame sections each include a fixed base member attached to the backing plate and a movable front or cover member that is hinged to the base member and which snaps down onto the display materials, backing plate member or base member in order to hold the display materials in place. Often, a transparent protective sheet is used in an attempt to protect and extend the life of the poster or advertising member in the frame. These front loading display devices are of reasonable cost, easy to manufacture, and allow easy removal and change of the advertisement or poster. The inside of the poster frame device can also be easily cleaned. However, these poster display devices do not sufficiently protect the poster and advertised materials from environmental conditions, such as rain, snow, condensation, and the like. If water or moisture is allowed to enter the display device and saturate the advertisement or poster, it may degrade or alter its appearance and effectiveness.

In an effort to overcome the problems associated with positioning poster display devices in outdoor environments, some display devices utilize a hinged door covering the display device. The hinged door has a transparent protective sheet of glass or Plexiglas® and is adapted to fit snugly over the front of the poster display device, protecting the advertisement and poster. However, these poster display devices are relatively expensive and difficult to assemble and install. The complexity of manufacture of these products often make it uneconomical to produce small quantities of them with different dimensions from standard measurements offered in catalogs of the various manufacturers.

The present invention is an improvement over the inventions disclosed and claimed in U.S. Pat. Nos. 4,145,828 and 3,310,901. The present invention is also related to the inventions disclosed and claimed in U.S. Pat. Nos. 4,523,400, 4,519,152, 4,512,094, and 4,958,458. All of these patents are owned by the assignee of the present invention, and the disclosures of all of them are hereby incorporated by reference herein.

SUMMARY OF THE INVENTION

The above-specified problems with poster display devices used in outdoor environments are met and overcome by the present invention. In accordance with the present invention, the poster display device includes a plurality of generally elongated frame sections, which preferably are made from an extruded metal material, a molded plastic material, or other suitable materials. Each frame member includes front and back (base) members adapted to be assembled in an aligned interconnected arrangement, and preferably pivotally interconnected together for relative movement throughout a range of pivoted positions. The frame sections are secured to or positioned around a backing member, which preferably is made from metal or another rigid durable material.

A protective transparent sheet member is utilized inside the poster display device in order to protect the poster or advertising materials which are displayed therein. The front or cover members of the frame section open and close in a snap-type mechanism in order to provide a front-loading poster display frame. This allows ease of removal and change of the poster or advertising materials and also allows ease of cleaning of the transparent sheet member and the poster display device.

A sealing member is positioned between each of the frame sections and the protective sheet member. The sealing member can have various configurations and be interlocked in channels in the frame sections so it cannot be inadvertently removed. Preferably, the seal is under permanent pressure from contact with the frame section against the transparent member and/or advertising materials, thereby forming a tight leak-proof closure between the frame section and the transparent protective sheet member. Also, in one embodiment, the sealing member is adapted to be easily removed for replacement if that becomes necessary or required.

Other benefits, uses and advantages of the present invention will become apparent from the following description of the invention, when viewed in accordance with the attached drawings and appended claims.

BEST MODE(s) FOR CARRYING OUT THE INVENTION

Figure 1:
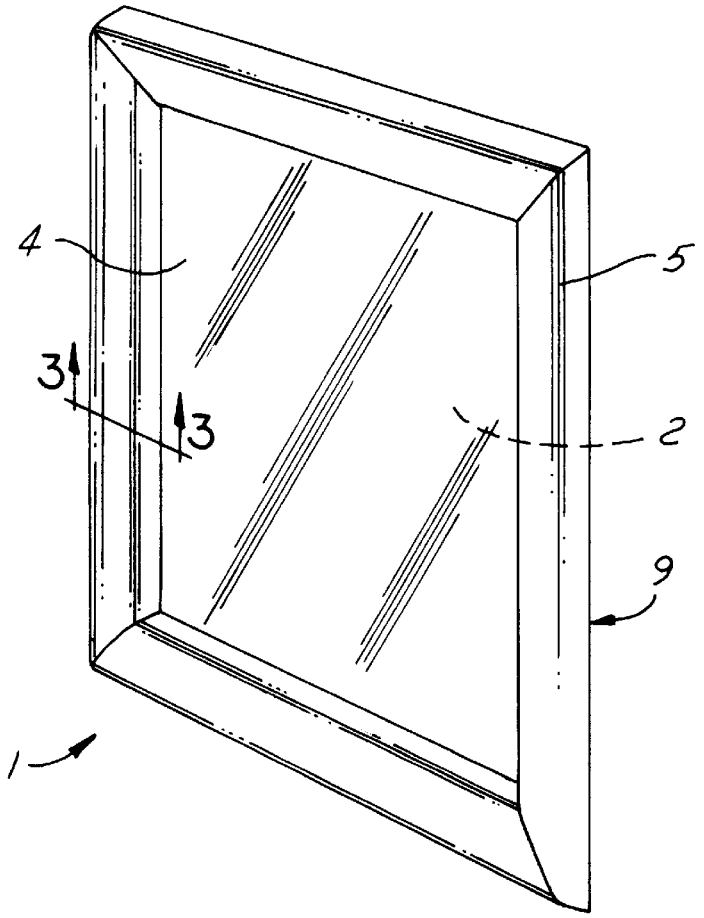
FIG. 1 is a perspective view of a poster display device in accordance with the present invention.

A first embodiment of the present invention is shown in FIGS. 1–4. The poster display device is generally referred to by the reference numeral 1. In these Figures, the frame device is utilized to hold and display a poster or advertising material 2. The poster or advertising materials 2 will hereinafter be referred to as "display materials" for simplicity and ease of reference.

The poster display device 1 comprises a backing plate member 3, a transparent protective sheet member 4, and a plurality of frame sections 5 attached to the periphery of the backing plate member. The backing plate member is preferably made of a durable rigid material, such as aluminum or an equivalent material. The transparent protective sheet member is preferably made of a plastic material, such as polycarbonate. The frame sections are preferably made from an extruded material, such as plastic or aluminum, but can be made of any other comparable or equivalent material that has similar aesthetics, durability, ease of manufacture, and expense.

The frame sections 5 each include a fixed back or base member 8 and a hinged or rotatable front or cover member 9. The base member 8 is generally L-shaped and has one flange member 10 which is longer than the other flange member 11.

In the present embodiment, backing plate member 3 is rectangular in shape and the frame sections 5 are attached to each of its side edges. The frame sections are provided equal in length to the corresponding sides of the backing member, are cut or mitered at 45 degree angles, and are joined together at the corners. Corner fixation members 6 of any conventional type and design are preferably used to hold the frame sections 5 together in a rectangular shape to form the frame device.

Figure 2:
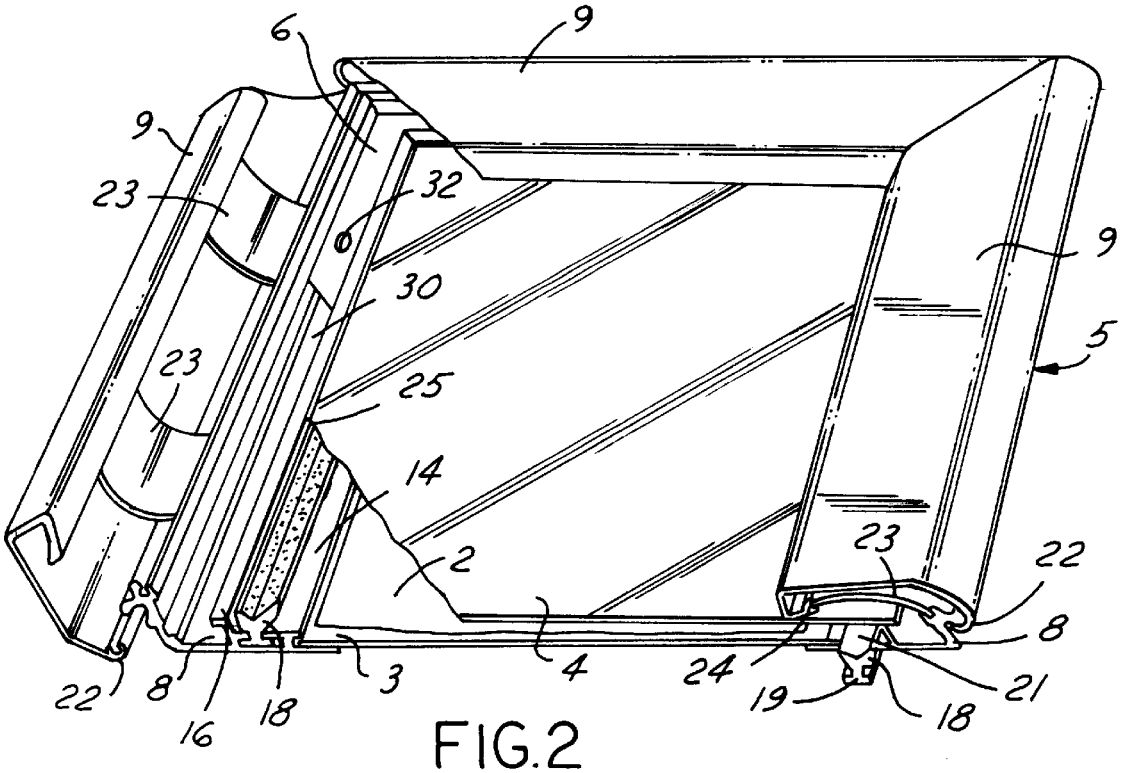
FIG. 2 is a perspective view of a portion of the poster display device shown in FIG. 1.
Figure 4:
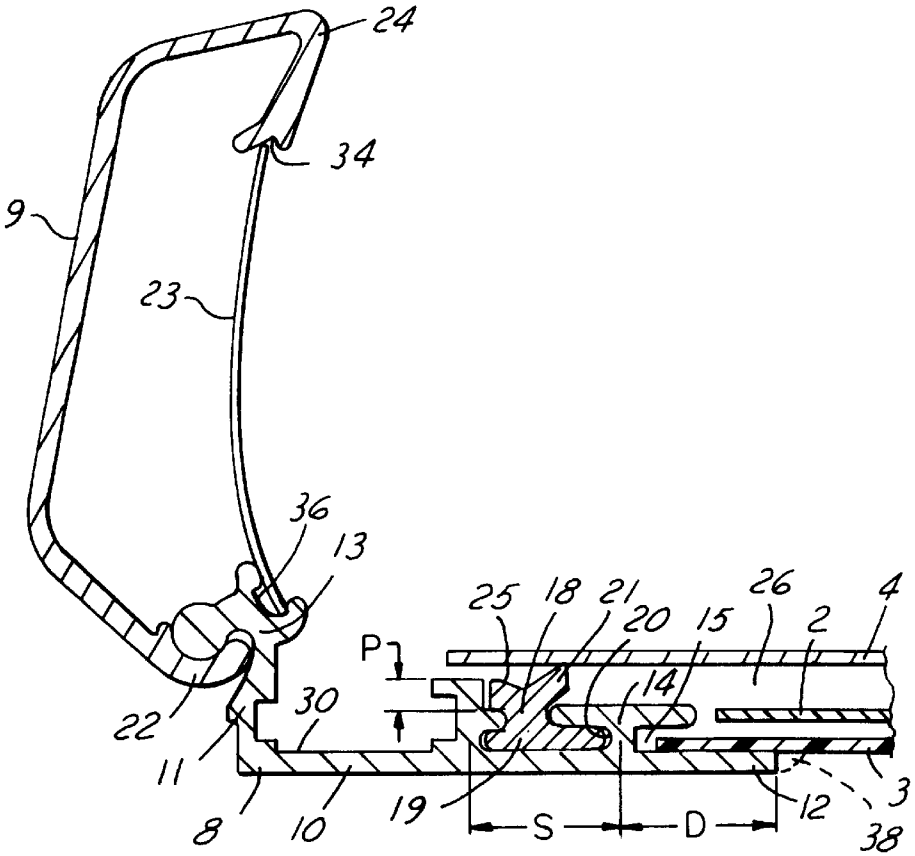
FIG. 4 is a cross-sectional view similar to FIG. 3, but with the front or cover member being shown in its open position.
Figure 3:
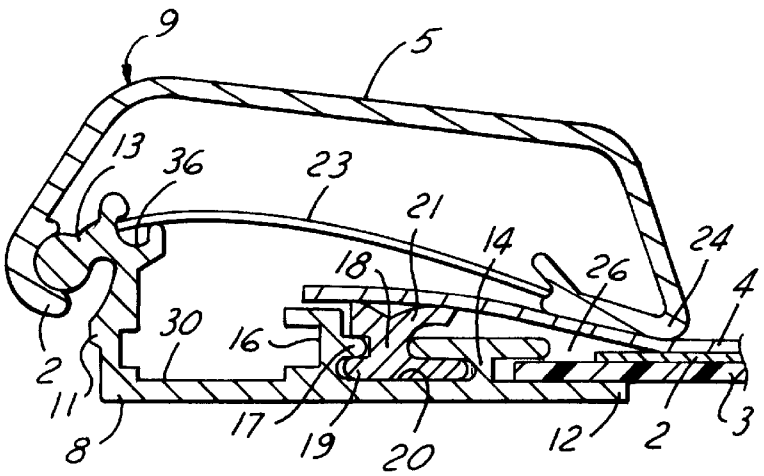
FIG. 3 is a cross-sectional view of one of the frame sections of FIG. 1, the cross-section being taken along line 3—3 in FIG. 1 and in the direction of the arrows.

As shown in FIGS. 2–4, each of the base members 8 of the frame sections are provided with a channel 30 for placement of the corner members 6. As is conventionally known, corner members 6 are attached to the frame sections by one or more fasteners, such as screws, pop rivets, or the like. Opening 32 is typically provided in the corner members 6 for this purpose.

The frame sections 5 are either positioned adjacent the outer edges of the backing member, or positioned around the outside edges of the backing member, the latter structure being preferred and which is shown in FIGS. 1–4. For this purpose, a channel 15 is provided in each of the base members of the frame sections. In this manner, when the four frame sections are secured together by corner members 6 in a rectangular frame shape, backing member 3 is tightly held in position within the frame.

The fixed base member 8 has a generally T-shaped projection member 14 projecting in the direction of the flange member 11. The edge 12 of the flange member 10 on the base member 8 is positioned at distance D from the T-shaped member 14 (see FIG. 4). The projection member 14 is parallel to the flange 11 and extends longitudinally along the full length of the base member 8. The T-shaped projection forms a C-shaped channel or recess 15 opening toward the edge 12 which accommodates the edge of the backing member 3, as mentioned above.

The base member 8 also includes a second projection member 16 which is also generally parallel to the projection member 14. The projection member 16 is positioned at a distance S toward the flange member 11 from the projection member 14. The projection member 16 also extends longitudinally along the full length of the backing member 8.

The projection member 16 extends outwardly or upwardly further from the flange member 10 of base member 18 than the T-shaped projection member 14. The difference in height between projection members 14 and 16 is indicated by the distance P in FIG. 4. A flange or rib member 17 protrudes from the projection member 16 in a direction toward the T-shaped projection member 14 and generally at the same height from the flange member 10 as the T-shaped projection member 14. The combination of projection members 14 and 16, together with rib member 17, form a slot 20.

A sealing member 18 is positioned in the slot 20 in the base member 8. The sealing member is preferably made of a rubber, plastic, or other comparable sealing material, and extends longitudinally along the full length of the frame sections 5. Preferably, as shown in FIGS. 2–4, the sealing member 18 has a generally H-shaped (or I-shaped) cross-section with a bottom flange 19 and a top flange 21. The bottom flange 19 is positioned in the slot 20 and securely holds the sealing member 18 in place in the base member 8.

Due to the material in which the sealing member 18 is made, the sealing member can be positioned in and removed from the slot 20 by "working it" into and out of the slot from above. In addition, the sealing member 18 can be positioned in the slot 20 in a longitudinal direction when the frame sections are disconnected from the backing member. This can be used when the sealing member has a less flexible or more solid composition. In addition, the invention allows easy replacement of the sealing member 18 when it is required or necessary to do so, thus allowing the poster frame device to have an extended duration and life. The invention further prevents inadvertent removal of the sealing member.

The upper portion 21 of the sealing member 18 has an appropriate shape and dimension in order to sealingly engage with an edge of the transparent protective sheet member 4. The portion 21 preferably rests on the T-shaped projection member 14 and on the rib member 17 of projection member 16. The sealing member 18 is contained laterally by the portion of the projecting member 16 indicated by the distance P in the drawings (FIG. 4).

The upper portion 21 of the sealing member 18 is provided and designed to form an essentially leak-tight and water-tight enclosure between the fixed base member 8 and the transparent protective sheet member 4.

The front or cover member 9 of the frame section has one end 22 connected by a rotatable hinge-type joint to the edge 13 of the flange member 11 of the base member 8. The cover member 9 is generally U-shape or arch-shape with the concave area thereof facing the base member 8.

Each of the frame sections 5 utilize members that enable the movable cover member 9 to be snapped onto the fixed base member 8. Preferably, as conventionally known, these members consist of a plurality of flat leaf springs 23 extending between a slot or channel 34 adjacent and extending along the unhinged edge 24 of the cover member 9 and a slot or channel 36 in the edge 13 of the base member 8. In this regard, FIG. 4 illustrates the base member 8 and cover member 9 in the "open" position. In this position, the spring members 23 hold the cover member in the open position and allow removal and change of the display materials 2. As shown in FIG. 2, two or more spring members 23 are preferably provided along the length of each of the frame sections 5.

FIG. 3 generally illustrates the frame sections with the cover member 9 being situated in the "closed" position. The unhinged edge 24 of the cover member 9 provides a force (caused by the spring member 23) to be applied on the transparent cover member and on the display materials 2. The force of the cover member 9 on the transparent protective member 4 places the cover member 4 in tight sealing engagement with the sealing member 18, thus preventing water and moisture from making contact with the poster and advertising materials 2.

Figure 7:
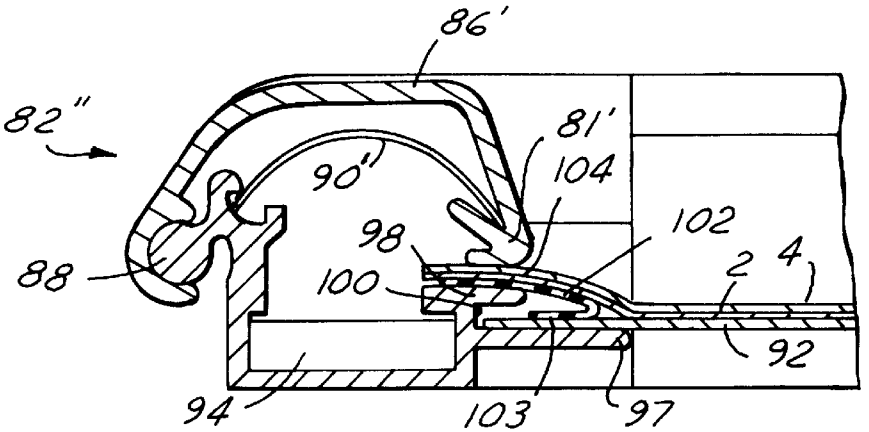
FIG. 7 illustrates an alternate embodiment of the invention shown in FIG. 6.

In an alternate embodiment, it is possible for the end 24 of the cover member to make contact directly over the sealing member 18, or over the position where portion 21 of sealing member 18 rests on projection member 14. Such an embodiment is shown in FIG. 7. This embodiment could provide a more secure and tight seal between the sealing member and protective sheet member 4.

The poster display device 1 is also provided with fastening means (not shown) for affixing it to a wall, frame, poster, or the like. These fastening devices and mechanisms are well known in the art and do not need to be described further.

The protective sheet member 4 and the backing member 3 are arranged parallel to each other and spaced apart so as to define a space 26 for positioning of the display materials 2. The sheet member 4 is supported by the seal 18 around its entire peripheral edge 25 and is contained laterally by the projection 16 of the base member 8.

During the assembly of the frame device 1, the frame sections 5 are attached to each side of the backing member 3. As stated above, the ends of the frame sections 5 are cut at 45 degree angles and are joined at right angles by the corner fixation members 6 to form the poster frame 1.

Fixing the frame sections 5 to the sides or edges of the backing member 3 is accomplished by pushing the base members 8 against the edges of the backing member so that the edges pass into the C-shaped channels or recesses 15 and abut against the projecting members 14. In order to prevent water and/or moisture from entering between the backing member 3 and the base member 8, the recesses or channels 15 are preferably filled with an adhesive, such as a silicon-type adhesive, before the backing members are positioned in them. In the alternative, it is also possible to provide a bead of silicon or other similar sealing material 38 between or at the edge 12 of the base member 8 and the backing member 3, as shown in phantom in FIG. 4.

When the frame device 1 is in use, the leaf spring members 23 exert a clamping force on the movable cover members 9 in the direction for snapping them down on the fixed base members 8. As a result, the unhinged ends 24 of the movable cover members 9 keep the protective cover sheet member 4 under permanent stress or force so that it remains in pressure contact with the sealing member 18. This creates the leak-type closure between the frame sections 5 and the protective sheet member 4.

In order to position the display materials 2 in the space 26, it is merely required to open the movable cover members 9 by exerting sufficient force to overcome the clamping forces applied by the spring members 23, and then to extract the protective sheet member 4 from the front of the poster frame device 1. Thereafter, after a replacement display member 2 has been positioned against the backing plate 3, the transparent sheet material member 4 is once again inserted in the frame device 1 and the movable rotatable cover members 9 are snapped down to their closed positions.

The sealing member 18 may also be inserted directly into the slot 20 of the base members 8 before the base members are cut and mitered into their desired lengths. This may facilitate the operation of assembling the poster frame device 1.

Also, the attachment of the sealing members 18 to the base member 8 prevents the sealing members 18 from inadvertently moving out of position when the protective sheet member 4 is removed from the frame to allow the advertising materials or posters 2 to be changed.

Figure 5:
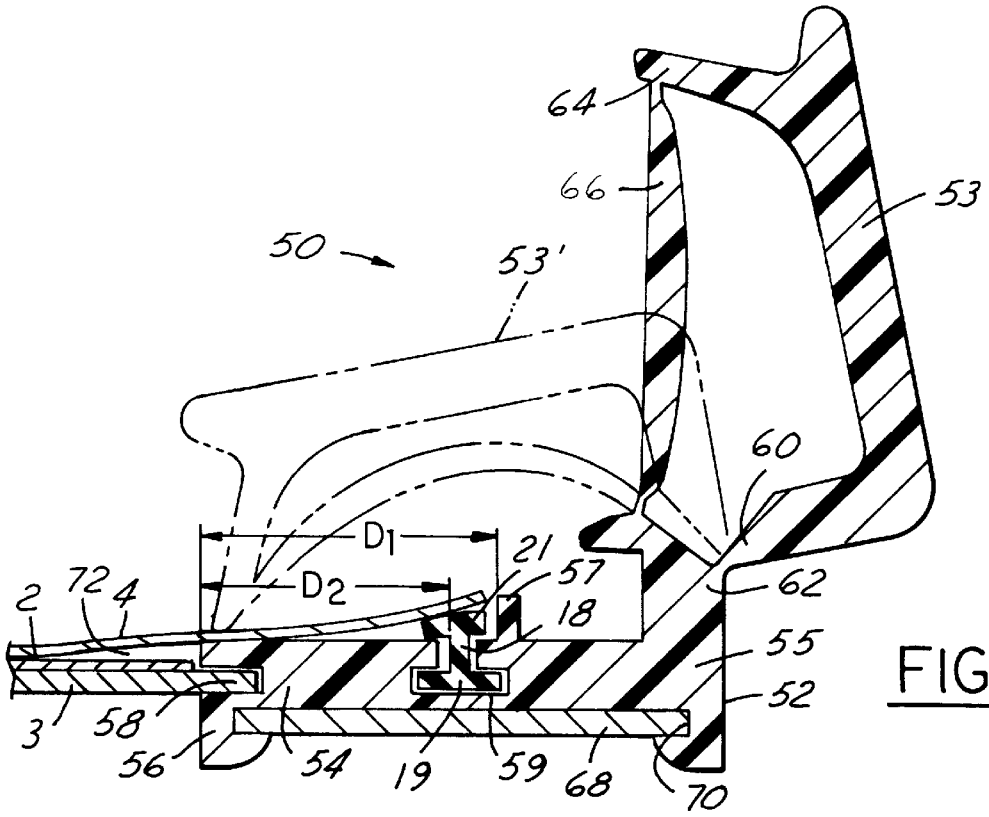
FIG. 5 is a view in cross-section of an alternate embodiment of the invention made from a plastic or similar material.

In the alternate embodiment shown in FIG. 5, the frame sections 5 of the poster frame device 1 are replaced by frame sections 50. Each frame section 50 includes a fixed base member 52 and a movable cover member 53. In this embodiment, the frame sections 50 are preferably made of an extruded plastic material, such as polyvinylchloride.

The base member 52 is L-shaped and has two flange members 54 and 55, with flange member 54 being longer than flange member 55. The base member 54 also has a projecting member 57 thereon which projects parallel to the flange member 55. The flange member 57 is positioned at distance D1 from the edge 56 of the flange 54. The projecting member 57 extends longitudinally the full length of the base member 52.

A recess or channel member 58 is provided at the edge 56 of the base member 52 in order to house the backing member 3.

Recess or slot 59 is formed in the base member 52 at a distance D2 from the edge 56. Slot 59 extends longitudinally the full length of the base member 52 and has a cross-sectional size and shape to match that of flange 19 on the sealing member 18. Again, the sealing member 18 is generally H-shaped (or I-shaped) and fits within the slot 59 in the base member 52, in the same manner as the sealing member 18 is positioned within the base member 8 in the embodiment shown in FIGS. 1–4.

The sealing member 18 extends longitudinally the full length of the base member 52 with its flange 19 inserted into the mating slot 59. The upper portion 21 of the sealing member 18 that is positioned above the slot 59 rests on the surface of the flange member 54 and is contained laterally by projecting member 57. In the same manner as indicated above with respect to frame sections 5, the sealing member 18 forms an essentially water-tight closure between the base member 52 and the transparent protective sheet member 4.

The cover member 53 is similar to cover member 9 described above and has an arch shape. One edge 60 is connected by a hinged joint to the edge 62 of the flange member 55 of the base member 52, in such a way that the concavity of the movable cover member 53 is toward the base member 52. The hinged joint is preferably a "living hinge" joint formed of the same plastic material as the base and cover members 52 and 53, respectively. The hinged joint is formed integrally with the members 52 and 53 when they are extruded. Processes to make such extruded shapes with living hinges are well known in the industry.

The unhinged edge 64 of the cover member 53 and the edge 62 of the base member 52 are connected by a resilient "spring member" 66. The resilient member 66 is formed in one piece with the cover and base members and acts in an appropriate direction to cause the movable cover member 53 to snap down onto the base member 52 in similar manner as caused by the leaf springs 23 in the frame sections 5 described above with reference to FIGS. 1–4.

The assembly and use of the poster frame device shown in FIG. 5 is similar to that described above with reference to the frame sections 5 shown in FIGS. 1–4. In this regard, a L-shaped corner member 68 is positioned in channel 70 formed in the base member 52 and used to hold the adjacent plastic members 50 in position around the backing member 3. In the alternative, the frame members 50 can be mitered and held together at their corners in any conventional manner. Also, it is possible for the frame sections 50 to be attached and/or secured to the backing member 3 in any other conventional manner. Preferably, however, a tight seal is formed between the backing member 3 and the frame sections 50 in order to prevent water and moisture from entering into the space 72 between the backing member and the transparent protective member 4. A silicone adhesive can be utilized for this purpose.

Figure 6:
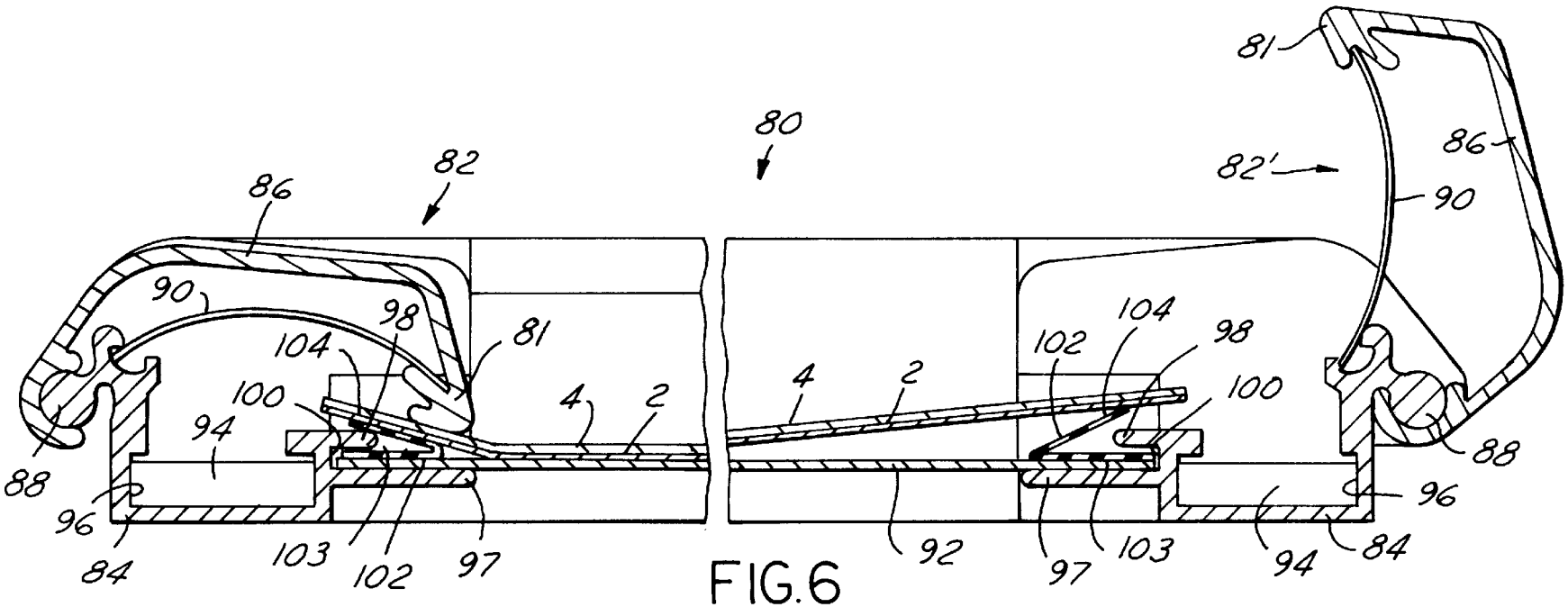
FIG. 6 illustrates an alternate embodiment of the present invention utilizing an alternative sealing member, the view being a cross-section of a poster frame device with one of the frame sections being closed and the other being open.

A still further embodiment of the present invention is shown in FIG. 6. In this embodiment, the poster frame device 80 is shown with a pair of identical frame sections 82 and 82', with frame section 82 being shown in its "closed" position, and frame section 82' being shown in its "open" position. Each of the frame sections 82 and 82' include a base member 84 and a rotatable cover member 86. The base member and cover member are hinged together by a cooperating hinge mechanism 88 similar to that described above with reference to FIGS. 1–4. The base member 84 and cover member 86 are resiliently hinged together by a spring member 90 which provides the necessary resilient force in order to hold the cover members 86 in their open and closed positions.

In forming the poster frame device 80, a plurality of frame sections, similar to those shown at 82 and 82', are secured together in a rectangular frame around a backing member 92. The frame sections are held together by L-shaped corner members 94 as conventionally known in the poster display field. The corner members 94 are positioned in corresponding channels or recesses 96 formed in the base members 84 of the frame sections. Each of the base members 84 have a first flange member 97 and a second flange member 98, both protruding toward the inner portions of the frame 80 and forming a recess or channel 100 therebetween.

An elongated sealing member 102 is positioned in each of the base members 84 of the frame sections 80 and 82'. The sealing members 102 are preferably made from a rubber or equivalent plastic material and have a generally V-shape, as shown in FIG. 6. In this regard, a first portion 103 of each of the sealing members 102 is positioned in the channel 100, while the other member 104 of the V-shaped sealing member 102 is positioned on top of the flange member 98.

After the display material 2 is positioned in the poster frame 80, a transparent protective sheet member 4 is positioned on top of it in order to protect it from moisture and other environmental conditions. In the embodiment shown in FIG. 6, the protective sheet member 4 is positioned on top of the flange members 104 of the sealing members 102, thus providing a water-tight seal when the cover members 86 are rotated and snapped to their closed positions. As indicated above, it is also possible for the unhinged end 81 of the cover member to be designed to engage the transparent sheet member 4 and the flange 104 of the sealing member 102 on top of flange member 98. Such an embodiment is shown in FIG. 7.

Various types and shapes of sealing members 102 can be utilized with the embodiment of the invention shown in FIG. 6. For example, the sealing member could have an H-shape or a C-shape, so long as one of the portions, flanges or legs is positioned in the recess or channel 100. In addition, the sealing member could extend over the entire top of the flange member 98 in order to improve its sealing qualities.

If the sealing member 102 deteriorates over time, it is a relatively simple and inexpensive matter to replace it. Once the cover members 86 are rotated to their open positions and the transparent protective sheet member 4 is removed, both the display materials and sealing member 102 can be easily removed and replaced.

Figure 8:
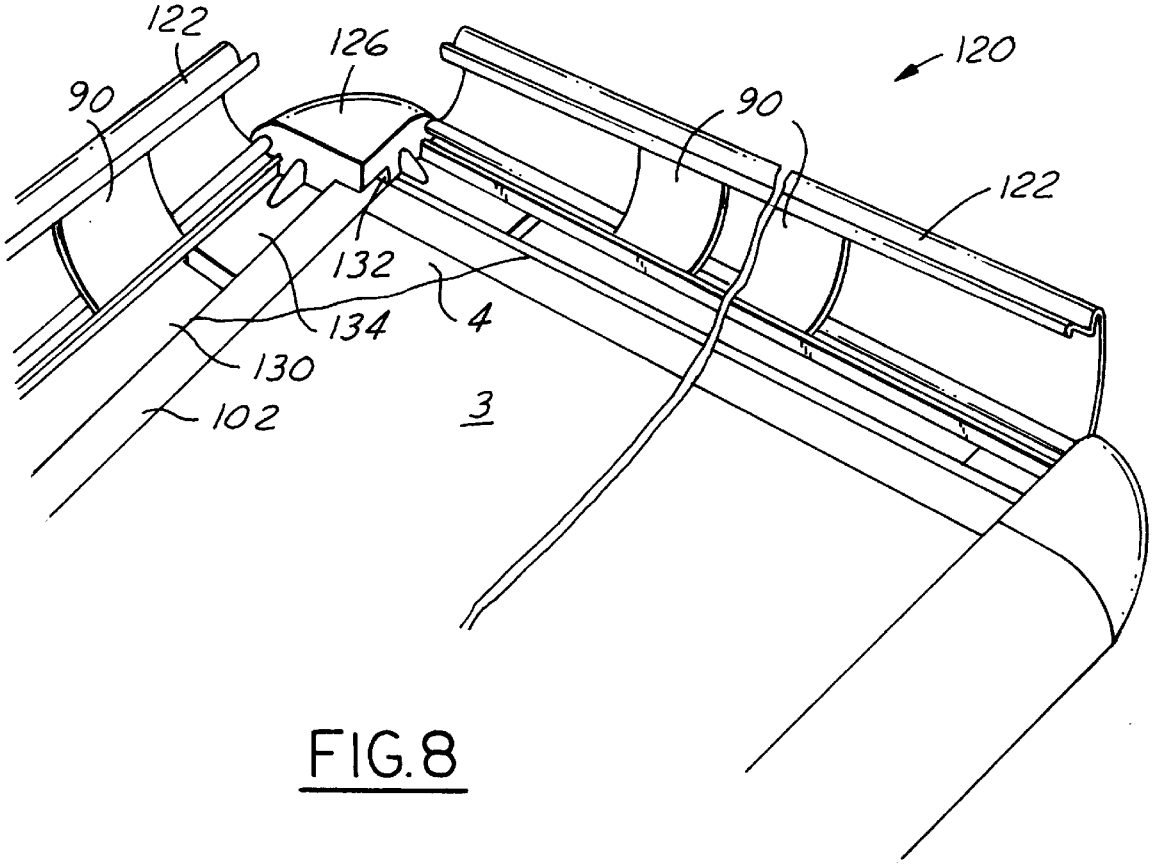
FIG. 8 illustrates still another embodiment of the present invention when used with a round-cornered poster frame.

Use of the present invention in a round-cornered picture and poster frame 120 is shown in FIG. 8. In this frame 120, the frame sections 122 and 124 have square ends and round corner members 126 are situated in each of the corners. The corner members 126 are preferably of the type shown in U.S. Pat. No. 5,076,736, which is commonly owned with the present invention. The disclosure of the '736 patent is hereby incorporated by reference herein.

The frame sections 122 and 124 each have cover members 128 and base members 130 which have the same cross-sectional sizes and shapes as cover and base members 86 and 84, respectively, described above. These frame sections each contain a V-shaped sealing member 102 and one or more spring biasing members 90.

At the corners of the frame 120, the round corner members have a recessed area 132 which extends over corners of the transparent sheet member 4 and display member 2. The corner members 126 each have a pair of leg members 134 which are positioned in channels 136 in the base members 130 and assist in fitting and holding adjacent frame sections together—as described in U.S. Pat. No. 5,076,736.

The sealing members 102 also extend within the recessed area 132 where adjacent sealing members from adjacent frame sections abut one another to form a seal around the entire periphery of the display materials.

As will be appreciated from the above description of the preferred embodiments of the present invention, the poster display device for holding and displaying advertising materials and posters meets the objects and purposes of the present invention, while at the same time overcoming the problems associated with prior art poster display devices situated in outdoor environments.

The present invention provides protection for the poster and advertising materials against external atmospheric agents, particularly water, moisture, and other condensation materials. The poster display devices in accordance with the present invention also are structurally and functionally relatively simple to manufacture, design and assemble. The present invention also allows the poster and advertising materials to be changed quickly and easily in a front-loading manner.

While the best modes for carrying out the invention have been described in detail, those familiar with the art to which this invention relates will recognize various alternative designs and embodiments for practicing the invention as defined by the following claims.

What is claimed is:

1. A water-tight poster display device comprising:

a backing member;

a plurality of frame sections positioned around the periphery of said backing member, each of said frame sections comprising a base member, a cover member, and a resilient biasing member, said cover member being hingedly secured to said base member, and said resilient member biasing said cover member to a first open position to allow positioning of posters and advertising materials in said device and a second closed position to firmly hold the posters and advertising materials in said device;

said base members having a first channel member therein;

a sealing member positioned in said first channel; and a transparent protective sheet member;

wherein when said cover member is rotated to said second closed position, said cover member holds said protective sheet member tightly against said sealing member around the entire periphery of said backing member.

2. The poster display device of claim 1 wherein said sealing member has an H-shape and has a first flange portion positioned in said first channel and a second flange portion adapted to sealingly engage said protective sheet member.

3. The poster display device of claim 1 wherein said sealing member has a V-shape and has a first flange portion positioned in said first channel and a second flange portion adapted to sealingly engage said protective sheet member.

4. The poster display device of claim 1 wherein each of said base members has an elongated channel therein, and said backing members are positioned in said elongated channels.

5. The poster display device of claim 4 further comprising sealing material positioned in said elongated channels in order to seal a joint between said base members and said backing members.

6. The poster display device of claim 4 further comprising a bead of sealing material positioned at a joint between said base members and said backing member.

7. The poster display device of claim 1 wherein said cover member and said base member are made for an extruded metal material and said resilient member comprises at least one leaf spring member.

8. The poster display device of claim 1 wherein said cover member and said base member are made from an extruded plastic material and said resilient member comprises an extruded biasing member formed integrally with said base and cover members.

* * * * *